US010309628B2

(12) United States Patent
Bader et al.

(10) Patent No.: US 10,309,628 B2
(45) Date of Patent: Jun. 4, 2019

(54) LIGHTING MEANS SUPPORT FOR A STRIP LIGHT LUMINAIRE

(71) Applicant: ZUMTOBEL LIGHTING GMBH, Dornbirn (AT)

(72) Inventors: Martin Bader, Dornbirn (AT); Wolfgang Bechter, Hittisau (AT); Wolfgang Gadner, Horbranz (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 66 days.

(21) Appl. No.: 15/524,448

(22) PCT Filed: Dec. 15, 2015

(86) PCT No.: PCT/EP2015/079730

§ 371 (c)(1),
(2) Date: May 4, 2017

(87) PCT Pub. No.: WO2016/096809

PCT Pub. Date: Jun. 23, 2016

(65) Prior Publication Data

US 2018/0274764 A1 Sep. 27, 2018

(30) Foreign Application Priority Data

Dec. 17, 2014 (DE) ..... 20 2014 106 106 U

(51) Int. Cl.
*F21V 21/088* (2006.01)
*F21S 8/02* (2006.01)
(Continued)

(52) U.S. Cl.
CPC ..... *F21V 21/088* (2013.01); *F21S 8/026* (2013.01); *F21S 8/04* (2013.01); *F21V 21/025* (2013.01);
(Continued)

(58) Field of Classification Search
CPC ..... F21V 21/088; F21V 21/025; F21V 23/06; F21S 8/026; F21S 8/04; F21Y 2103/10; F21Y 2115/10
(Continued)

(56) References Cited

U.S. PATENT DOCUMENTS

2015/0109772 A1 4/2015 Ladstaetter
2016/0061395 A1* 3/2016 White ..... F21S 2/00 362/147
2017/0089553 A1* 3/2017 Ladstatter ..... F21V 27/00

FOREIGN PATENT DOCUMENTS

DE 4300549 7/1994
DE 9415415.5 11/1994
(Continued)

OTHER PUBLICATIONS

German search report dated May 17, 2015 in priority German Application 20 2014 106 106.1.
(Continued)

*Primary Examiner* — Ali Alavi
(74) *Attorney, Agent, or Firm* — Andrus Intellectual Property Law

(57) ABSTRACT

The invention relates to a lighting means support (10) for a strip light luminaire, comprising: at least one spring element (20) for detachably connecting the lighting means support (10) to a strip light rail (1) of a strip light luminaire; wherein the at least one spring element (20) comprises at least one latching element (22) which can be brought into engagement with a correspondingly formed latching element or a correspondingly formed wall section (2) of the strip light rail (1) in order to latch the lighting means support (10) to the strip light rail (1) in such a way that movement of the lighting means support (10) counter to an insertion direction of the lighting means support (10) into the strip light rail (1) is
(Continued)

prevented. The invention further relates to a strip light luminaire having at least one lighting means support (10) according to the invention.

16 Claims, 3 Drawing Sheets

(51) Int. Cl.

| | |
|---|---|
| ***F21S 8/04*** | (2006.01) |
| ***F21V 21/02*** | (2006.01) |
| ***F21V 23/06*** | (2006.01) |
| *F21Y 103/10* | (2016.01) |
| *F21Y 115/10* | (2016.01) |

(52) U.S. Cl.
CPC ..... *F21V 23/06* (2013.01); *F21Y 2103/10* (2016.08); *F21Y 2115/10* (2016.08)

(58) Field of Classification Search
USPC ..... 362/217.16
See application file for complete search history.

(56) References Cited

FOREIGN PATENT DOCUMENTS

| | | |
|---|---|---|
| DE | 69404743 | 2/1998 |
| DE | 29817256 | 12/1998 |
| DE | 102004016485 | 10/2005 |
| DE | 202012101765 | 10/2013 |
| EP | 0150271 | 8/1985 |
| EP | 1293724 | 3/2003 |
| EP | 1801495 | 6/2007 |

OTHER PUBLICATIONS

International Search Report dated Feb. 17, 2016 in parent PCT Application PCT/EP2015/079730.
Austria search report dated Dec. 5, 2016 in co-pending Austria application GM 177/2015.

* cited by examiner

LIGHTING MEANS SUPPORT FOR A STRIP LIGHT LUMINAIRE

CROSS REFERENCE TO RELATED APPLICATION

The present application is the U.S. national stage application of International Application PCT/EP2015/079730, filed Dec. 15, 2015, which international application was published on Jun. 23, 2016 as International Publication WO 2016/096809 A1. The International Application claims priority to German Patent Application 20 2014 106 106.1, filed Dec. 17, 2014.

FIELD OF THE INVENTION

The present invention relates to a lighting means support for a strip light rail as well as a strip light luminaire with such a lighting means support.

BACKGROUND

A plurality of different strip light luminaires is known from the prior art. Above all, large areas with long light lines adapted to these areas (for example supermarkets, factory halls, office areas etc.) can be equipped with strip light luminaires or strip light systems. Ordinarily, these strip light luminaires have u-shaped strip light rails in which the cabling, the (control) electronics and the lighting sources are arranged.

To simplify assembly, it is further known to build the strip light luminaire with modular units. For example, Publication DE 20 2012 101 765 U1 discloses arranging a first module in the form of a device support and a second module in the form of a lighting means support in a u-shaped strip light rail.

The device support has, in particular, a converter unit arranged thereon for electrically coupling the lighting means to the external power supply inserted into the strip light luminaire. The lighting means support comprises in the process the actual lighting means, for example in the form of light emitting diodes or fluorescent tubes.

In practice, it turns out that in the assembly of such a strip light luminaire the arrangement of the lighting means support in the strip light rail is relatively awkward and thus time-consuming, since these components are often screwed into one another or must be attached to one another in a separate work step. In addition, the maintenance of such a strip light luminaire is likewise time-consuming, since the connection between the lighting means support and the strip light rail must first be disengaged in a separate step, in order to be able to get to the device support underneath.

Proceeding from the prior art, the present invention addresses the problem of providing a lighting means support for a strip light rail which can be easily brought into engagement with a strip light rail and which can be easily removed from the strip light rail for maintenance work.

This and other problems to be mentioned in the following description or which can be recognized by a person skilled in the art are solved with the subject matter of the independent claims.

SUMMARY OF THE INVENTION

A lighting means support for a strip light luminaire according to the invention comprises:

at least one spring element for detachably connecting the lighting means support to a strip light rail of a strip light luminaire;

wherein the at least one spring element comprises at least one latching element which can be brought into engagement with a correspondingly formed latching element or a correspondingly formed wall section of the strip light rail in order to latch the lighting means support to the strip light rail in such a way that movement of the lighting means support counter to an insertion direction of the lighting means support into the strip light rail is prevented.

In other words, the present invention proposes providing a spring element with at least one latching element on the lighting means support that automatically latches to the strip light rail during the insertion of the lighting means support into the strip light rail, and to be precise, in such a way to prevent the lighting means support from falling out from the strip light rail (that is, in the direction counter to the insertion direction).

Advantageously, the spring element is formed as a separate component and arranged on the lighting means support. The spring element preferably comprises at least one fastening element which can be brought into engagement with a correspondingly formed holding fixture on the lighting means support. It is preferable that the fastening element of the spring element be conically formed and can be undetachably (preferably positive form locking) arranged in the holding fixture of the lighting means support by a corresponding configuration of the holding fixture. Such a configuration makes it possible to arrange the spring element on the lighting means support prior to assembly, so that during the assembly no separate parts must be held or no screw connections or the like must be performed.

Further, it is preferred that the latching element of the spring element comprises at least one insertion chamfer, which in the case of the insertion of the lighting means support into the strip light rail can be brought into contact with the correspondingly formed wall section of the strip light rail in such a way that the latching element of the spring element bends away from the strip light rail. For example, when inserting the lighting means support into the strip light rail, a corbel of the strip light rail can press against the insertion chamfer of the spring element, so that the latching element of the spring element is pressed away during insertion and only snaps back to its original position to fasten once insertion is complete. In the fastening position, the latching element comes into contact with the corbel of the strip light rail on a contact surface and hence prevents a movement of the lighting means support against the insertion direction.

It is further preferred that the spring element comprises at least two (preferably identical) latching elements spaced apart from one another. As a result, an especially stable connection of the lighting means support in the strip light rail can be provided.

Advantageously, the spring element is arranged on an interior of the lighting means support and the at least one latching element is guided through a correspondingly formed recess in the lighting means support (thus inserted on the exterior of the lighting means support). The lighting means support is molded u-shaped when viewed in cross-section. In this case, it is preferred that the spring element is arranged on an interior of a leg of the u-shaped lighting means support (preferably spring elements are provided on both opposing legs of the u-shaped lighting means support).

Advantageously, the spring element is integrally formed, wherein it is especially preferred that the spring element is formed as a stamped/bent part (preferably made of sheet metal). This makes it possible to make a spring element in essentially only one process step.

Further, it is preferred that the spring element comprises at least one support and clamping element which can be brought into engagement with a corresponding wall section of the lighting means support in such a way that the spring element is clamped on the lighting means support between the fastening element and the support and clamping element. The undetachable arrangement of the spring element on the lighting means support can be improved. In addition, it can be ensured that in the bending away of the latching element or latching elements (when inserting the lighting means support into the strip light rail) the remaining spring element remains in the provided position.

Preferably, relief slots are provided adjacent to the support and clamping element, so that the support and clamping element is not likewise bent way when the spring element is bent away.

Advantageously, the lighting means support comprises at least two spring elements on opposing wall sections of the lighting means support (in the u-shaped embodiment of the lighting means support preferably on two opposing legs of the lighting means support). To increase the stability of the connection between the lighting means support and the strip light rail, the spring element is preferably provided on a front region of the lighting means support or the spring elements are preferably provided on opposing front regions of the lighting means support.

Advantageously, the lighting mean support further comprises at least one first plug-in connector arrangement, which is formed in such a way that it is brought into engagement with a second plug-in connector arrangement arranged on a device support, in order to connect the lighting means support to a power supply circuit. This power supply circuit is typically provided by a converter unit arranged on the device support. The at least one spring element of the lighting means support and the latching element or the wall section of the strip light rail are molded and positioned in such a way that a latching does not occur until the two plug-in connector arrangements, as provided, are in engagement with one another. In other words, the latching element should only latch into a fastening position when the two plug-in connectors are in the proper installation position (and hence an electrical connection of the plug-in connector arrangements is present). This further simplifies the assembly of a strip light luminaire according to the invention.

Further, the present invention relates to a strip light luminaire having at least one of the above described lighting means supports.

BRIEF DESCRIPTION OF THE DRAWINGS

In the following a detailed description of the figures is given. The figures show the following.

DETAILED DESCRIPTION

Figure 1:
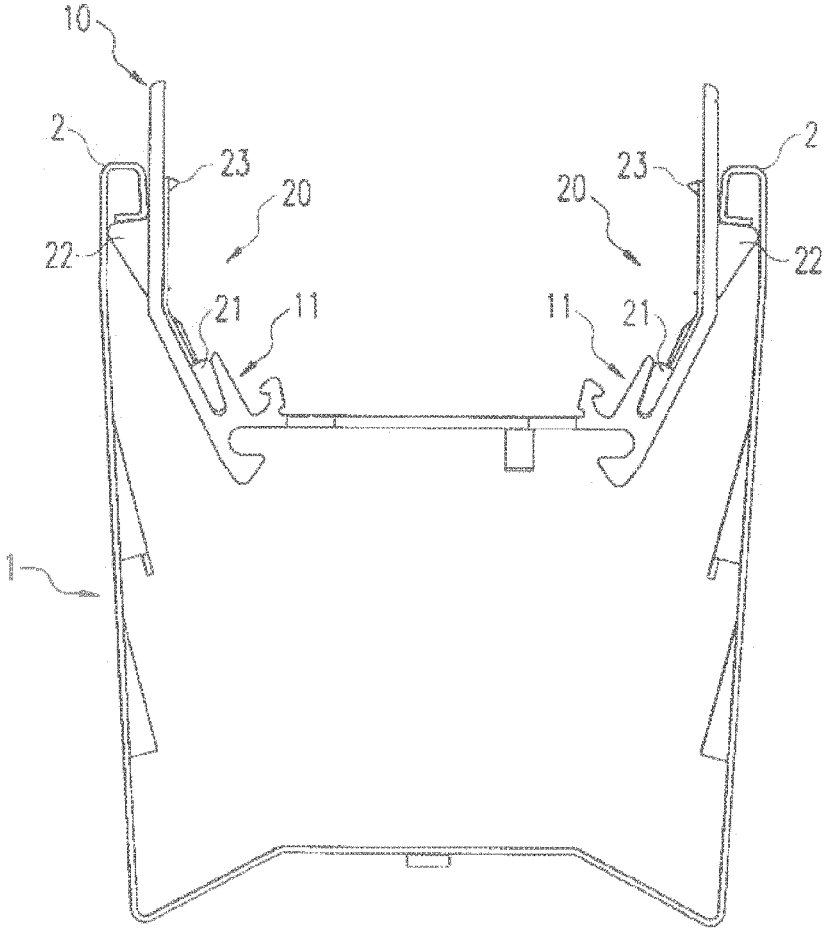
FIG. 1 shows a schematic view of a strip light rail with a lighting means support arranged therein (without lighting means)

FIG. 1 shows a schematic view of a strip light rail 1, in which a lighting means support 10 is arranged.

As clearly shown in FIG. 1, the strip light rail 1 has an essentially u-shaped cross-section, wherein corbels 2 are provided on the upper sides of the legs.

As likewise clearly shown in FIG. 1, the lighting means support 10 has a u-shaped cross-section adapted to the u-shaped cross-section of the strip light rail 1. The lighting means support 10 further comprises spring elements 20 on opposite interiors of the legs of the u-shaped cross-section. Said spring elements 20 latch the lighting means support 10 to the strip light rail 1.

Figure 2:
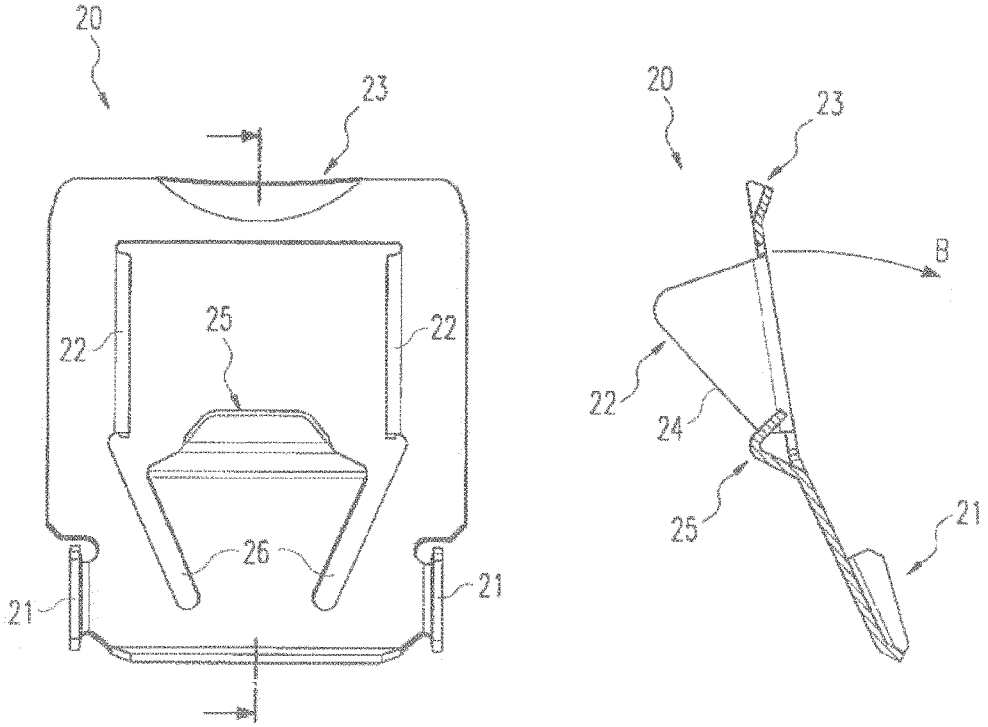
FIG. 2 shows schematic views of a spring element which was used in the representation shown in FIG. 1 for connecting the lighting means support to the strip light rail.

The spring elements 20 are molded as flat stamped/bent components (cf. FIG. 2). In the region that is aligned to the base of the u-shaped lighting means support 10, the spring elements 20 comprise fastening elements 21, which are essentially conically formed and which are arranged in the correspondingly formed holding fixture 11 of the lighting means support 10 (preferably positively and non-positively locked).

Further, the spring elements 20 comprise latching elements 22, which are guided through the lighting means support 10, so that the corbels 2 of the strip light rail 1 work together and can latch into place with them.

On the ends of the spring elements 20 opposite the fastening elements 21 there are engagement and/or grip sections 23, upon which an assembler can grip the spring elements 20 and bend them inward such that the latching elements 22 are guided inward and the lighting means support 10 can be removed from the strip light rail 1 again.

FIG. 2 shows two schematic views of a spring element 20, with which the lighting means support 10 can be latched in the strip light rail 1 (cf. FIG. 1).

As clearly shown in FIG. 2, the fastening elements 21 of the spring element 20 are arranged spaced apart from one another and have an essentially conical shape, said fastening elements being able to be inserted into the correspondingly formed holding fixture 11 of the lighting means support 10 (preferably positively locked).

As already stated, through the arrangement of the fastening elements 21 in the holding fixture 11 an undetachable arrangement of the spring element 20 on the lighting means support 10 is provided.

The latching element 22 is provided by two wall sections 22 essentially protruding at a right angle from the spring element 20, wherein the latching elements 22 comprise insertion chambers 24.

Further, the spring element 20 comprises a (preferably centrally arranged) support and clamping element 25, which can be brought into engagement with a corresponding further holding receptacle of the lighting means support 10 in such a way that the spring element 20 is clamped between the fastening elements 21 and the support and clamping element 25 on the lighting means support 10. As an alternative or in addition to this, it is also possible to clamp the spring element 20 between the latching element 22 and the fastening element 21 on the lighting means support 10.

As FIG. 2 shows, relief slots 26 are provided laterally to the support and clamping element 25, and extend from the support and clamping element 25 in the direction of the fastening elements 21. The relief slots 26 are intended to prevent the support and clamping element 25 from being bent out of engagement with the lighting means support 10 in the case of the bending or swiveling of the spring element 20.

In order to connect the lighting means support 10 to the strip light rail 1, the following procedure can be employed:

first, the fastening elements 21 of a respective spring element 20 are inserted into the correspondingly formed holding fixtures 11 (preferably non-positively and positively locked);

then the support and clamping element 25 of a respective spring element 20 is brought into a corresponding holding fixture (not shown in the figure) of the lighting means support 10, so that the respective spring element 20 is clamped between the fastening elements 21 and the support and clamping element 2 on the lighting means support 10;

now the lighting means support 10 is inserted into the strip light rail 1 in such a way that the corbels 2 of the strip light rail 1 come into contact with the insertion chamfers 24 of the latching elements 22. During further insertion, the latching elements 22 are pressed inward (indicated by Arrow B in FIG. 2) until the positioning shown in FIG. 1 is achieved and the latching elements 22 return to the shown original position.

If the lighting means support 10 is removed from the strip light rail 1 again, the assembler can manually bend the spring element 20 on the engagement and/or grip section 23 in such a way that the latching element 22 is guided inward and the lighting means support 10 can be removed from the strip light rail 1. As an alternative, an adapted assembly tool can be arranged on the engagement and/or grip section 23 in order to be able to perform a corresponding bending of the spring element 20 and with it the latching elements 22 (cf. Arrow B in FIG. 2).

Further, it is preferred that the spring element 20 or the spring elements 20 are arranged and positioned on the device support 10 in such a way that a latching only occurs (cf. FIG. 1) when a first plug-in connector arrangement (not shown in the figure) of the lighting means support 10 is correctly brought into engagement with a second plug-in connector arrangement (not shown in the figure) of a device support likewise arranged in the strip light rail 1, so that the latching also is an indicator for a correct connection of the two plug-in connector arrangements.

Figure 3:
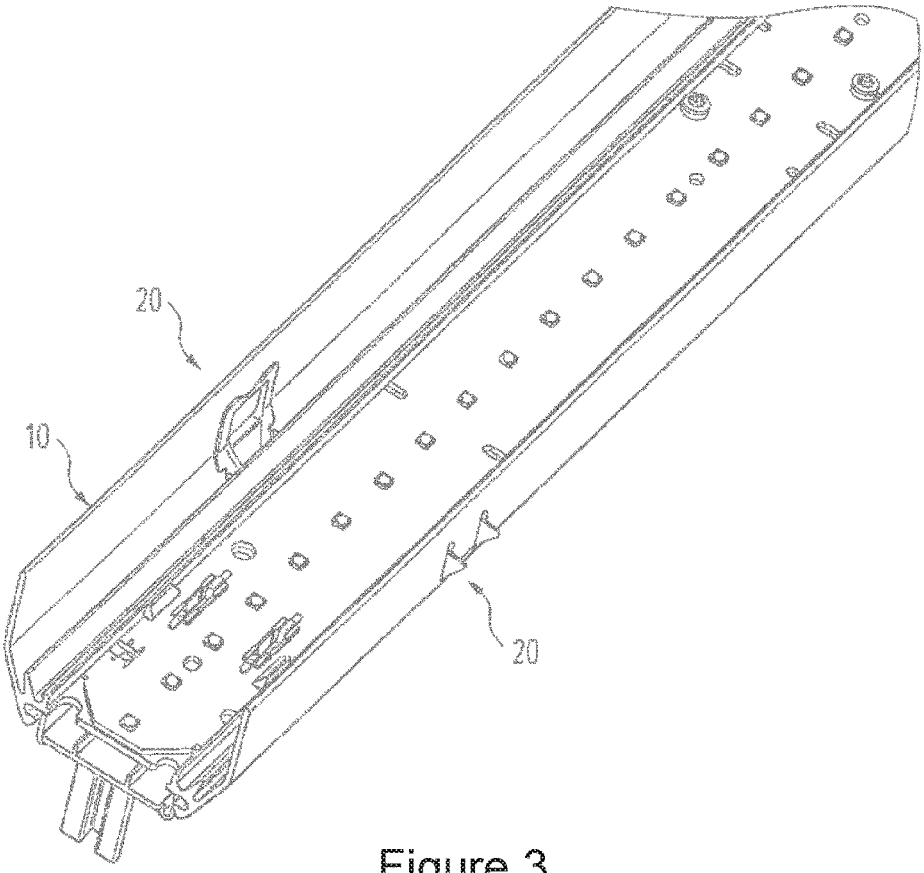
FIG. 3 shows a schematic view of a lighting means support according to the invention.

FIG. 3 shows a schematic view of a lighting means support 10 according to the invention, wherein two opposing spring elements 20 are provided on a front region, in order to be able to connect the lighting means support 10 to a strip light rail 1 (cf. FIG. 1).

The present invention is not restricted to the preceding described preferred exemplary embodiment, as long as it is comprised by the subject matter of the following claims. In particular, the present invention is not restricted to the use of a specified number of spring elements 20, i.e. depending on the application case and dimensioning of the strip light luminaire, more or fewer spring elements 20 can be provided on the lighting means support 10. Further, the present invention is also not restricted to the number of fastening elements 21/latching elements 22 provided on the spring element 20, i.e. one, two (as shown in the figures) or a plurality of fastening elements 21/latching elements 22 can be provided on a spring element 20 according to the invention.

What is claimed is:

1. A strip light luminaire comprising:

a strip light rail (1) having a generally u-shaped cross section with opposing legs;

a lighting means support (10) having a generally u-shaped cross section with opposing legs configured to be arranged within the strip light rail (1) such that opposing legs on the lighting means support reside adjacent the respective opposing legs on the strip light rail;

at least one spring element (20) on one of the legs of the lighting means support for detachably connecting the lighting means support (10) to a strip light rail (1) of a strip light luminaire;

wherein the at least one spring element (20) comprises at least one latching element (22) which can be brought into engagement with a correspondingly formed latching element or a correspondingly formed wall section (2) on an adjacent leg of the strip light rail (1) in order to latch the lighting means support (10) to the strip light rail (1) in such a way that movement of the lighting means support (10) counter to an insertion direction of the lighting means support (10) into the strip light rail (1) is prevented; and wherein the spring element (20) is formed as a separate component from the leg of the lighting means support.

2. A strip light luminaire according to claim 1, wherein the lighting mean support (10) comprises at least one first plug-in connector arrangement, which is formed in such a way that it is brought into engagement with a second plug-in connector arrangement arranged on a device support, in order to connect the lighting means support (10) to a power supply circuit, which is provided by a converter unit arranged on the device support, wherein the at least one spring element (20) of the lighting means support (10) and the latching element or the wall section (2) of the strip light rail (1) are formed and positioned in such a way that a latching does not occur until the two plug-in connector arrangements are in engagement with one another.

3. A strip light luminaire according to claim 1, wherein the spring element (20) comprises at least one fastening element (21), which can be brought into engagement with a correspondingly formed holding fixture (11) of the lighting means support (10).

4. A strip light luminaire according to claim 3, wherein the fastening element (21) of the spring element (2) is conically formed and can be undetachably arranged in the holding fixture (11) of the lighting means support by a corresponding configuration of the holding fixture (11).

5. A strip light luminaire according to claim 3 wherein the fastening element (21) of the spring element (2) is undetachably arranged in the holding fixture (11) of the lighting means support by a corresponding configuration of the holding fixture (11).

6. A strip light luminaire according to claim 3, wherein the spring element (20) comprises at least one support and clamping element (25) which can be brought into engagement with a corresponding wall section of the lighting means support (10) in such a way that the respective leg of the spring element (20) is clamped on the lighting means support (10) between the fastening element (21) and the support and clamping element (25).

7. A strip light luminaire according to claim 6, wherein relief slots (26) are provided adjacent to the support and clamping element (25) on the spring element.

8. A strip light luminaire according to claim 1, wherein the spring element (20) is integrally formed.

9. A strip light luminaire according to claim 1, wherein the spring element (20) is formed as a stamped/bent part.

10. A strip light luminaire according to claim 1, wherein the latching element (22) of the spring element (20) comprises at least one insertion chamfer (24), which in the case of the insertion of the lighting means support (10) into the strip light rail (1) can be brought into contact with the correspondingly formed wall section (2) on the adjacent leg of the strip light rail in such a way that the latching element (22) of the spring element (20) bends resiliently away from the strip light rail (1) to insert the chamfer.

11. A strip light luminaire according to claim 1, wherein the spring element (20) comprises two latching elements spaced apart from one another, where each latching element engages the strip light rail directly.

12. A strip light luminaire according to claim 1, wherein the spring element (20) comprises at least one engagement and/or grip section (23) which is spaced apart from the respective leg to which the spring element (20) is connected.

13. A strip light luminaire according to claim 1, wherein at least one spring element (20) is provided on each opposing leg of the lighting means support (10).

14. A strip light luminaire according to claim 1, wherein at least two spring elements (20) are provided on each opposing leg of the lighting means support (10).

15. A strip light luminaire according to claim 1, wherein the spring element (20) is provided on a front region of the lighting means support (10) or the spring elements (20) are provided on front regions of the lighting means support (10).

16. A strip light luminaire according to claim 1, wherein the spring element (20) is arranged on an interior of the respective leg on the lighting means support (10) and the at least one latching element (22) is guided through a correspondingly formed recess in the respective leg of the lighting means support (10).

* * * * *